US005345992A

United States Patent [19]

Turner

[11] Patent Number: 5,345,992

[45] Date of Patent: Sep. 13, 1994

[54] SHOWER CURTAIN CONFORMAL SUPPORT

[76] Inventor: Jeffrey B. Turner, 105 Woodbridge Dr., Charleston, W. Va. 25311-1127

[21] Appl. No.: 118,713

[22] Filed: Sep. 10, 1993

[51] Int. Cl.[5] ..... A47H 1/00

[52] U.S. Cl. ..... 160/330; 160/DIG. 6; 4/558; 4/608; 16/87.2

[58] Field of Search ..... 160/330, DIG. 6; 211/105.2; 4/610, 608, 558, 154, 149; 16/87.4, 94 D, 89, 93 D

[56] References Cited

U.S. PATENT DOCUMENTS 2,878,487 3/1959 Foote .
4,385,409 5/1983 File et al. .
4,466,476 8/1984 Fairbanks .
5,097,541 3/1992 Annano .
5,170,974 12/1992 Ruggiero .
5,201,081 4/1993 Knight .

*Primary Examiner*—Blair M. Johnson

[57] ABSTRACT

A slidably mounted curtain support for supporting a curtain having an intermediate portion and a pair of spaced end portions at the end edge portions thereof in overlapping relation with at least one end wall of a pair of spaced end walls, which, with a rear wall, defines an enclosure such as a shower tub enclosure. The curtain support is slidably mounted to a support rod and includes a body and a support arm disposed in normal relation. The body supports the end edge portion of the curtain, and the support arm supports the body. A separate, attachable, downwardly extending arm serves as a handle to aid in the slidable movement of the curtain along the rod.

7 Claims, 5 Drawing Sheets

SHOWER CURTAIN CONFORMAL SUPPORT

FIELD OF THE INVENTION

The present invention relates to a shower curtain support for suspending a shower curtain at the ends thereof in overlapping relation with at least a portion of the end walls defining a shower area.

BACKGROUND OF THE INVENTION

In a typical shower or tub stall defined by a rear wall, two end walls and an opening, a shower curtain is suspended from a shower curtain rod by a plurality of attachment members, generally rings or hooks, which are slidably mounted on the shower curtain rod, allowing the shower curtain to be opened or closed within the stall opening. When closed, the ends of the shower curtain simply follow the straight path of the shower curtain rod and hang in perpendicular relation against the end walls of the stall. This generally results in a gap between the ends of the shower curtain and the end walls of the stall, providing an inefficient seal for keeping water from splashing out.

There are various prior art devices which purport to solve this problem. One such device is a sliding or hinged glass door. However, such doors are relatively expensive and complicated to install.

U.S. Pat. No. 4,769,862, issued to Skrzelowski on Sep. 13, 1988, discloses a type of shower curtain rod and not a separate bracket type support.

U.S. Pat. No. 2,923,013, issued to Wasserman on Feb. 2, 1960, discloses a shower bar attachment which rigidly attaches to the shower curtain rod to, in effect, become an integral part of the shower curtain rod, and not a bracket type support that is slidably attached to the shower curtain rod.

U.S. Pat. No. 2,878,487, issued to Foote on Mar. 24, 1959, and U.S. Pat. No. 4,385,409, issued to File et al. on May 31, 1983, both disclose a shower curtain support which utilizes a plurality of hinges or pivots to impart the desired function, resulting in a support that is overly complex.

U.S. Pat. No. 5,170,974, issued to Ruggiero on Dec. 15, 1992, discloses a shower curtain support which relies on a counter-weight extending outwardly from the stall to balance with the end edge portion of the shower curtain extending inwardly into the stall, resulting in a support that is both overly complex and visually obtrusive.

U.S. Pat. No. 5,201,081, issued to Knight on Apr. 13, 1993, discloses a shower curtain support which is installed in conjunction with the first three attachment openings inward from either appropriate end of the shower curtain. As a shower curtain opens by folding at and between each attachment opening, such a design will restrict the amount the shower curtain will open by a distance equal to its own length. In a typical installation utilizing two such supports, with one support at each end of the shower curtain, this results in the mount the shower curtain will open being overly restricted, leaving an inconveniently small opening as access to the stall.

All of the aforementioned patents disclose useful devices, however none of them succeed in providing a practical shower curtain support that is both simple in design and uncompromising in function.

SUMMARY OF THE INVENTION

Accordingly, the present invention provides a shower curtain support of uncomplicated design which is functionally practical and visually unintrusive. The device of the present invention includes a body for supporting the end edge portion of a shower curtain, and a support arm for supporting the body. The support arm and one end portion of the body slidably attach to the shower curtain rod, while the major portion of the body extends inwardly into the shower stall supporting the end edge portion of the shower curtain in overlapping relation against the end wall of the shower stall. A separate, attachable handle serves as a grasping point for slidably opening and closing the shower curtain along the shower curtain rod.

It is an object of the present invention, therefore, to provide a practical, inexpensive shower curtain support.

It is another object of the present invention to provide such a shower curtain support for use in conjunction with standard shower curtains, standard shower curtain rods, and standard shower curtain attachment members, such as shower curtain rings and shower curtain hooks.

It is still another object of the present invention to provide such a shower curtain support for mounting the shower curtain inwardly at its end edges in a manner which places its inwardly directed end edges in substantially overlapping, mating relation with the end walls of a shower stall or the like.

It is yet a further object of the present invention to provide such a shower curtain support for mounting the shower curtain to a shower curtain rod for slidable movement of the shower curtain along the shower curtain rod.

Other objects of the present invention will become apparent from the following detailed description taken in conjunction with the accompanying claims and drawings.

DETAILED DESCRIPTION OF THE INVENTION

Figure 1:
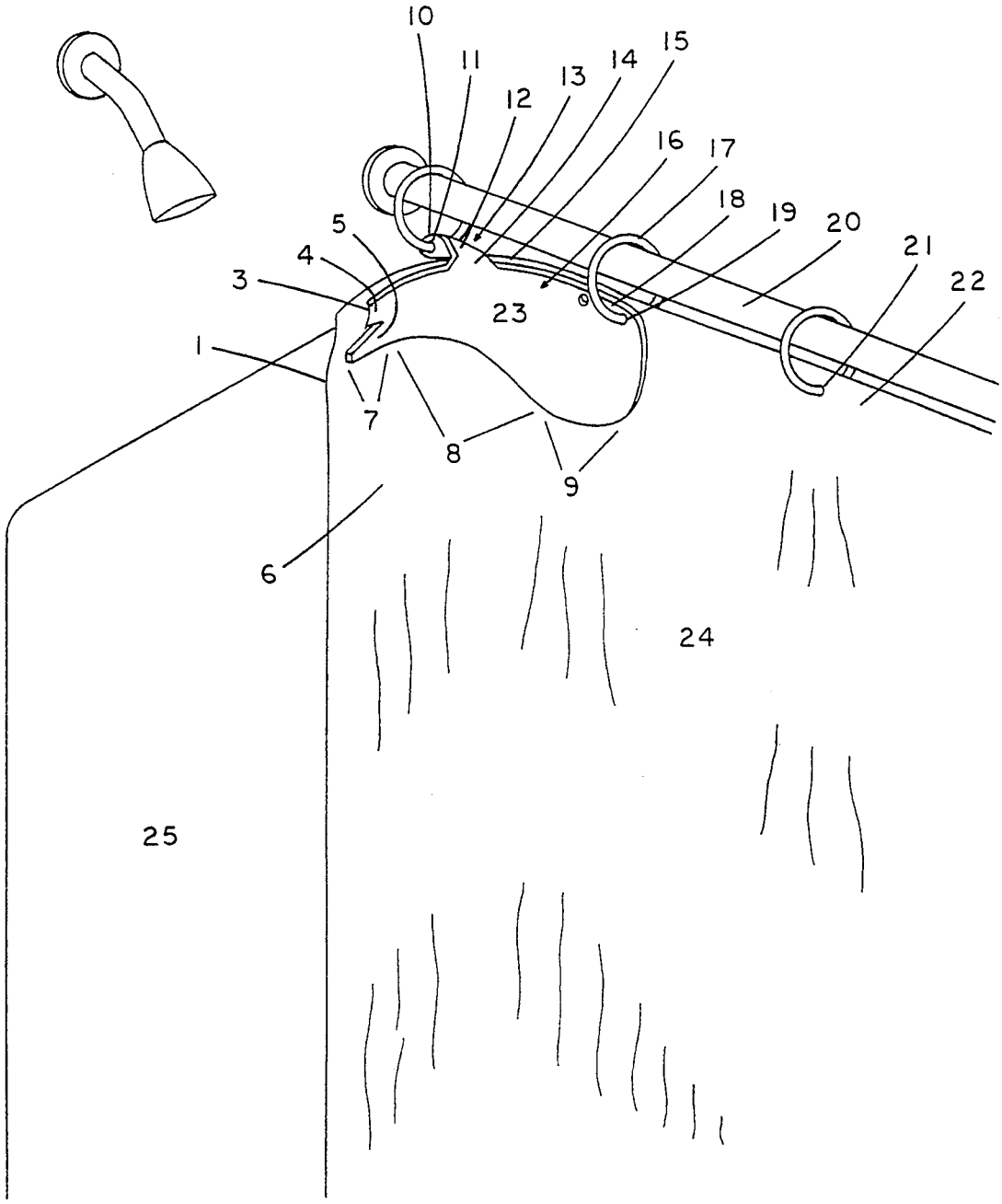
FIG. 1 is a partial pictorial view of a shower enclosure utilizing the device of the present invention for holding an end edge portion of a shower curtain in overlapping relation against an end wall of a shower enclosure.

Referring to the drawings wherein like numerals refer to like parts, FIG. 1 illustrates the use of the shower curtain conformal support 23 in a shower enclosure having a pair of end walls 25 (only one shown) and a rear wall (not shown). A curtain rod 20 is attached to the end walls and extends across the open portion of the enclosure. A shower curtain 24 is slidably suspended on curtain rod 20 by attachment rings 17 which extend through attachment openings 21 provided in spaced relation along the top marginal material 22 of the shower curtain 24.

Shower curtain conformal support 23 is shown positioned at one end edge portion 6 of shower curtain 24. Although shower curtain conformal support 23 would typically be installed in pairs, with one support at each end of the shower curtain, only one is shown.

Figure 2:
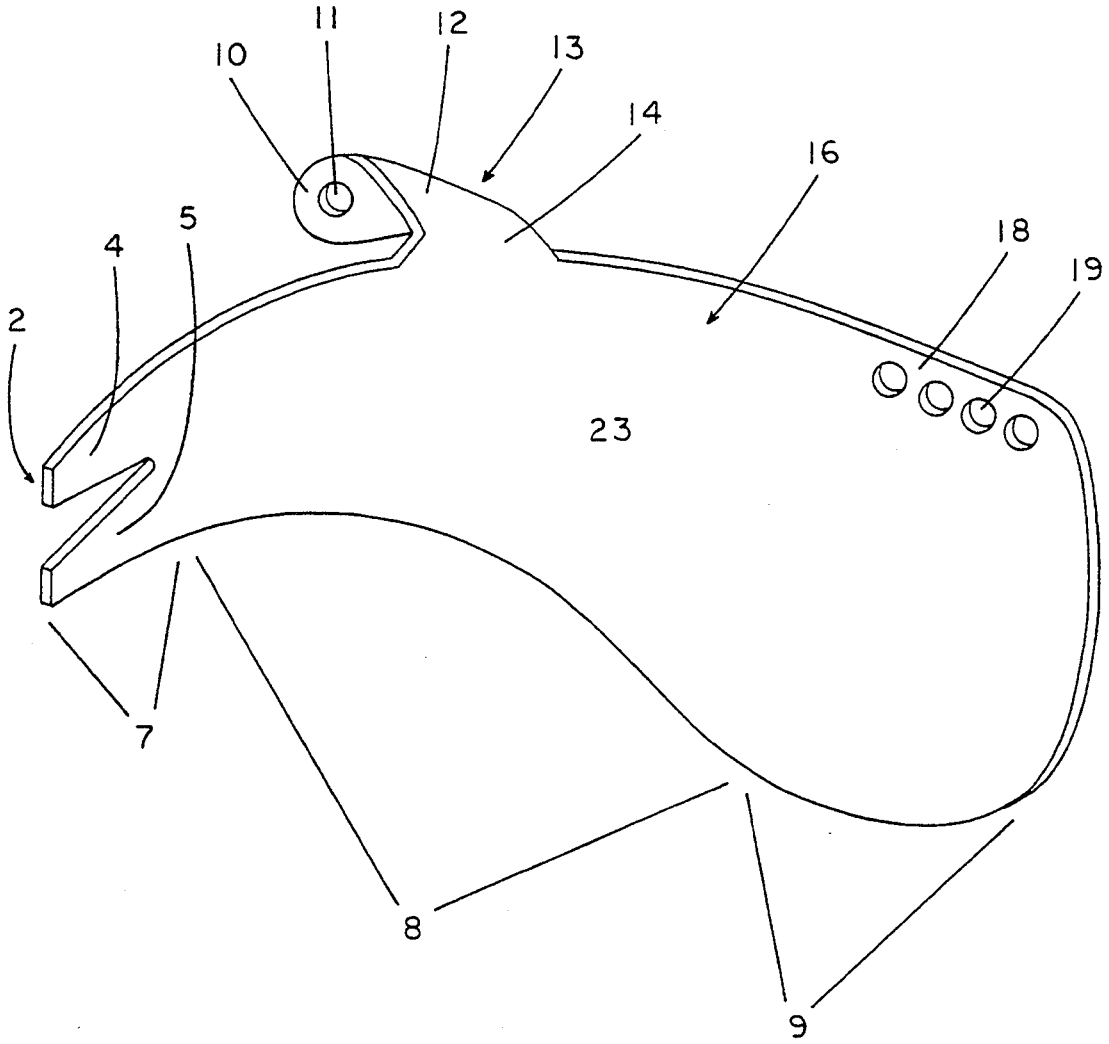
FIG. 2 is a pictorial view of a shower curtain conformal support.

Still referring to FIG. 1 for an overall view of the shower enclosure while also referring to FIG. 2 for a more specific view of the support itself, shower curtain conformal support 23 is shown to be a single unitary member having a body 16 and a support arm 13. Body 16 consists of an intermediate portion 8, a primary end portion 9, and a secondary end portion 7. The intermediate portion 8 disposes the primary end portion 9 and secondary end portion 7 in substantially perpendicular orientation. Primary end portion 9 contains a plurality of spaced openings 19 in its upper marginal material 18 allowing attachment to curtain rod 20 in conjunction with attachment rings 17. Secondary end portion 7 contains primary tab 4 and secondary tab 5. Primary tab 4 provides attachment to the end edge portion 6 of the shower curtain 24 by engaging the first attachment opening 3 inward from the end edge i of the shower curtain 24. Primary tab 4 tapers toward its distal end 2 which allows the first attachment opening 3 of shower curtain 24, through the slight expansion of the surrounding material thereof, to be varibly positionable along the length of primary tab 4. The end edge 1 of shower curtain 24 is bent inwardly through attachment to primary tab 4. This is rectified by secondary tab 5 which disposes the end edge 1 of shower curtain 24 back into alignment with secondary end portion 7 of body 16.

Support arm 13 projects from body 16. Support arms primary end portion 14 extends from body 16 to allow clearance for the top edge 15 of shower curtain 24. Support arms intermediate portion 12 extends from support arms primary end portion 14 disposing support arms secondary end portion 10 in alignment with primary end portion 9 of body 16. Support arms secondary end portion 10 is provided with an opening 11 allowing attachment to curtain rod 20 in conjunction with attachment rings 17.

Figure 3:
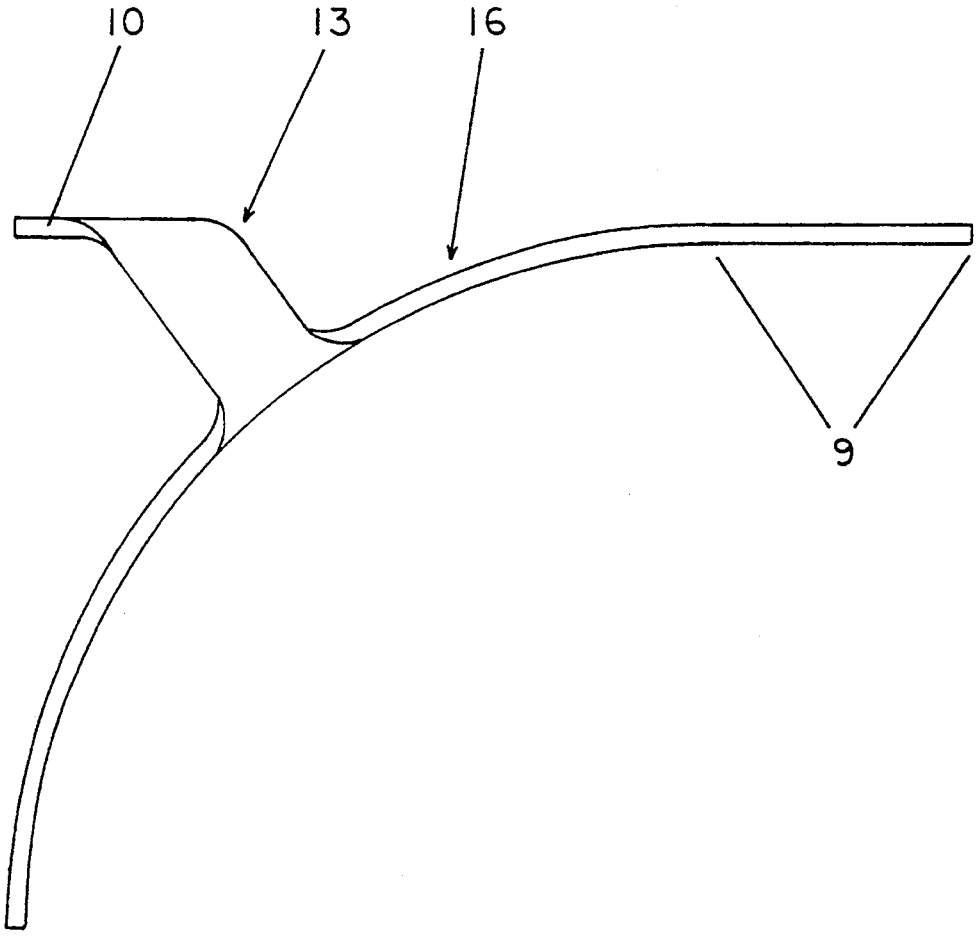
FIG. 3 is a pictorial view of a shower curtain conformal support as viewed from directly above.

Referring now to FIG. 3, the relation of the support arm 13 to the body 16 can be more clearly seen, and more specifically, the relative position of the secondary end portion 10 of support arm 13 in relation to the primary end portion 9 of body 16.

Figure 4:
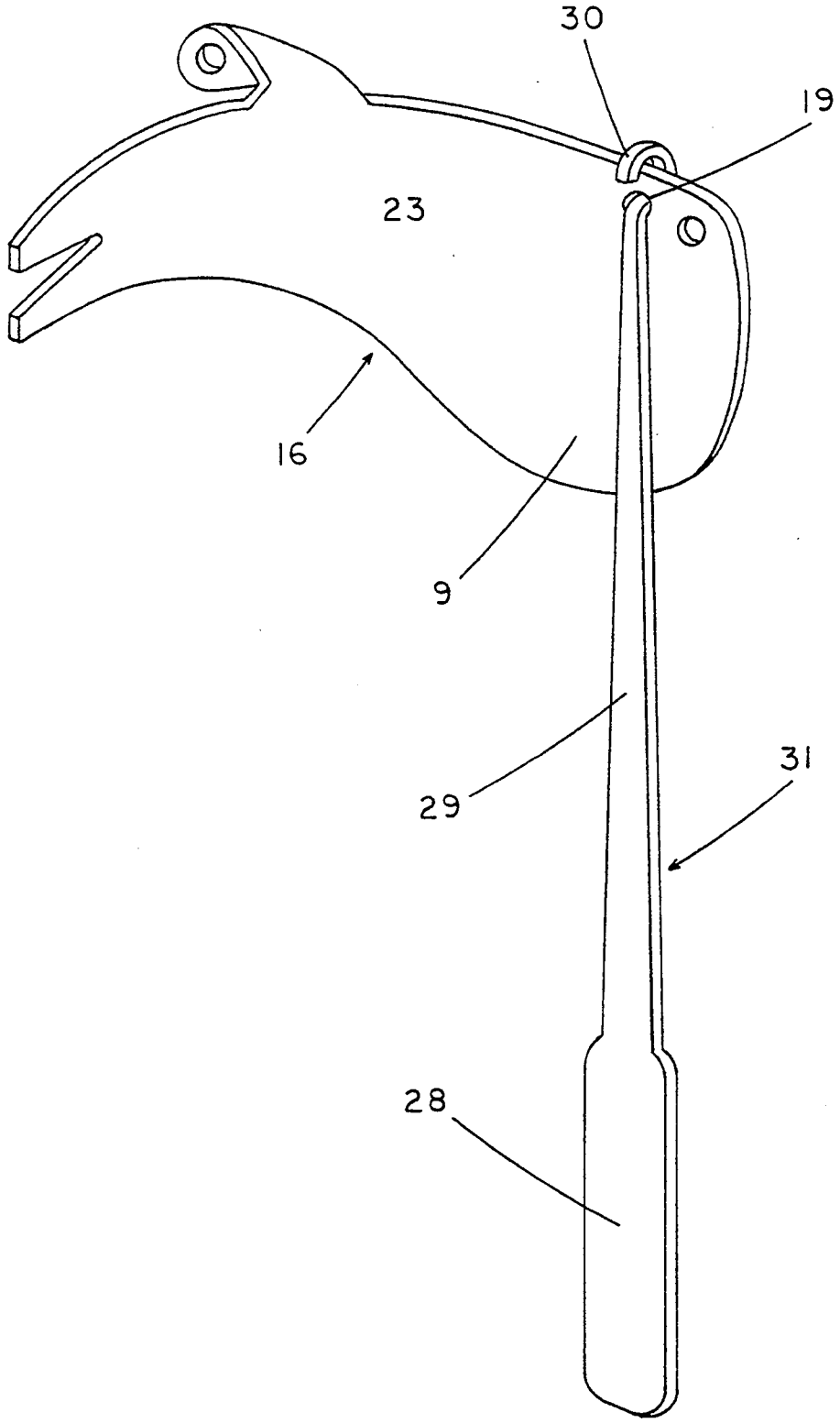
FIG. 4 is a pictorial view of a shower curtain conformal support with a grasping handle installed.

Referring now to FIG. 4, shower curtain conformal support 23 is shown with a grasping handle 31 installed. Grasping handle 31 is shown to be a single unitary member having a handle portion 28, an extension portion 29, and an attachment hook 30. Attachment hook 30 engages an opening 19 of primary end portion 9 of body 16, providing a nonrigid juncture which allows the grasping handle to swing inwardly into the enclosure, providing clearance from the shower curtain for the grasping hand. A grasping handle 31 is not necessary for the function of the shower curtain conformal support 23, but provides a more convenient way for opening and closing the shower curtain than simply grasping the shower curtain directly.

Figure 5:
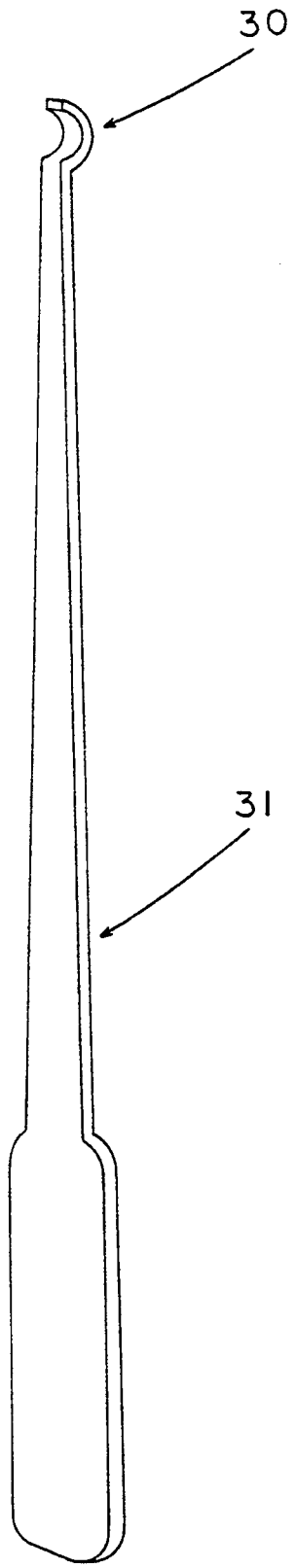
FIG. 5 is a pictorial view of a grasping handle.

FIG. 5 illustrates another embodiment of the grasping handle 31 wherein the attachment hook 30 is shown to be an arc of substantially 170 degrees circumferentially.

It is to be understood that any of many types of materials, including plastics, may be used in the construction of the shower curtain conformal support as set forth herein.

It is to be further understood that although the support structure is described herein as supporting a shower curtain, the invention is not to be strictly held in such a limiting sense, since the support structure may be used for any enclosure in which a curtain or the like is to be used as a covering for the opening thereof.

While particular embodiments of the concept of my invention have been disclosed, it is to be understood that those skilled in the art may make various changes and modifications without departing from the spirit and scope of the appended claims.

I claim:

1. In combination with a curtain having end edges, end edge portions, an intermediate portion, and a top edge portion having a plurality of spaced openings therein, a curtain rod extending between a pair of spaced end walls which, with a rear wall, define an enclosure, means for slidably supporting said curtain on said curtain rod, comprising:

a curtain support including a body having a primary end portion, an intermediate portion, and a secondary end portion, and a support arm having a primary end portion, an intermediate portion, and a secondary end portion, said intermediate portion of said body disposing said primary and said secondary end portions of said body in generally perpendicular orientation, said primary end portion of said body having a plurality of spaced openings along the upper marginal material thereof, said secondary end portion of said body having a primary tab and a secondary tab, said primary end portion of said support arm extending from said intermediate portion of said body, said intermediate portion of said support arm disposing said secondary end portion of said support arm in alignment with said primary end portion of said body, said secondary end portion of said support arm having an opening in the distal end material thereof;

first attachment means for attaching said primary end portion of said body and said intermediate portion of said curtain to said curtain rod, said first attachment means defined by a singular member of a plurality of curtain attachment members slidably carried on said curtain rod extending through a singular member of said spaced openings in said primary end portion of said body and through a singular member of said spaced openings along said top edge portion of said curtain whereby said primary end portion of said body and said top edge portion of said curtain are attached together and to said curtain rod for slidable movement therealong;

second attachment means for attaching said support arm to said curtain rod, said second attachment means defined by a singular member of a plurality of said curtain attachment members slidably carried on said curtain rod extending through said opening in said secondary end portion of said support arm whereby said support arm is attached to said curtain rod for slidable movement therealong;

third attachment means for attaching said secondary end portion of said body to said curtain, said third attachment means defined by said primary tab of said secondary end portion of said body extending from said body for insertion into a singular member of said spaced openings along said top edge portion of said curtain near at least one said end edge of said curtain.

2. The combination of claim 1 wherein said body and said support arm is a one-piece member.

3. The combination of claim 1 wherein said primary tab of said secondary end portion of said body tapers toward its distal end, allowing said opening of said curtain, through the slight expansion of the material of said curtain surrounding said opening, to be variably positionable along the length of said primary tab.

4. The combination of claim 1 wherein said secondary tab of said secondary end portion of said body disposes said end edge of said curtain in alignment with said secondary end portion of said body.

5. The combination of claim 1 wherein said enclosure is a shower enclosure.

6. The combination of claim 1 including having openings, a grasping handle comprising, an elongated handle means including a hook-like member extending from one distal end of said handle means for insertion into a said opening in said curtain support, providing attachment of said handle means to said curtain support, said handle means serving as a handle for a user to grasp in order to move said curtain along said curtain rod.

7. The combination of claim 6 wherein said hook-like member is an arc of substantially 180 degrees circumferentially.

* * * * *